US010582738B2

(12) United States Patent
Pellegrino

(10) Patent No.: US 10,582,738 B2
(45) Date of Patent: Mar. 10, 2020

(54) SHOE SYSTEM

(71) Applicant: Luigi Pellegrino, Cerritos, CA (US)

(72) Inventor: Luigi Pellegrino, Cerritos, CA (US)

( * ) Notice: Subject to any disclaimer, the term of this patent is extended or adjusted under 35 U.S.C. 154(b) by 20 days.

(21) Appl. No.: 16/027,236

(22) Filed: Jul. 3, 2018

(65) Prior Publication Data

US 2020/0008515 A1 Jan. 9, 2020

(51) Int. Cl.

| | |
|---|---|
| ***A43B 3/12*** | (2006.01) |
| ***A43B 3/24*** | (2006.01) |
| ***A43B 23/02*** | (2006.01) |
| ***A43B 23/24*** | (2006.01) |

(52) U.S. Cl.

CPC ..... *A43B 3/242* (2013.01); *A43B 3/12* (2013.01); *A43B 3/122* (2013.01); *A43B 3/24* (2013.01); *A43B 3/244* (2013.01); *A43B 23/02* (2013.01); *A43B 23/24* (2013.01)

(58) Field of Classification Search

CPC ..... A43B 3/12; A43B 3/122; A43B 3/126; A43B 3/24; A43B 3/244

USPC ..... 36/11.5, 100, 101, 15

See application file for complete search history.

(56) References Cited

U.S. PATENT DOCUMENTS 2,112,761 A * 3/1938 Buehner ..... A43B 3/122 36/11.5
2,853,806 A * 9/1958 White ..... A43B 3/126 36/11.5
3,000,116 A * 9/1961 Ally ..... A43B 3/122 36/101
3,925,915 A * 12/1975 Colli ..... A43B 3/103 36/11.5
4,887,369 A * 12/1989 Bailey ..... A43B 3/24 36/101
5,992,058 A * 11/1999 Jneid ..... A43B 3/122 36/100
7,877,903 B2 * 2/2011 Barteet ..... A43B 3/103 36/100
2003/0192205 A1 * 10/2003 Linens ..... A43B 1/0027 36/100
2004/0064976 A1 * 4/2004 Barteet ..... A43B 3/103 36/100
2004/0128859 A1 * 7/2004 Cambronero ..... A43B 3/122 36/11.5
2005/0262738 A1 * 12/2005 Gerber ..... A43B 3/103 36/101
2007/0209238 A1 * 9/2007 Barteet ..... A43B 3/103 36/101
2007/0240336 A1 * 10/2007 Richardson ..... A43B 1/0054 36/101
2007/0261267 A1 * 11/2007 Osborn ..... A43B 3/103 36/15
2008/0022558 A1 * 1/2008 Kaufer ..... A43B 3/0031 36/100
2009/0193684 A1 * 8/2009 Diamond ..... A43B 1/0081 36/101
2011/0283564 A1 * 11/2011 Stillwagon ..... A43B 3/103 36/101
2015/0040434 A1 * 2/2015 Perkins ..... A43B 1/0054 36/101

(Continued)

*Primary Examiner* — Marie D Bays

(57) ABSTRACT

The invention includes a shoe system including a sole having attached fasteners and interchangeable uppers having complementary fasteners. In other embodiments, the invention includes particular uppers that may be used in such a shoe system.

20 Claims, 7 Drawing Sheets

(56) References Cited

U.S. PATENT DOCUMENTS

| | | | | |
|---|---|---|---|---|
| 2015/0082660 | A1* | 3/2015 | Ofray, Sr. ..... | A43B 17/10<br>36/11.5 |
| 2016/0242493 | A1* | 8/2016 | Stillwagon ..... | A43B 3/242 |

* cited by examiner

SHOE SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of the Invention

This invention is in the field of shoes with interchangeable uppers.

Shoes are expensive and bulky to store or transport. However, many wearers desire multiple styles or colors of shoes for different types of use, for different occasions, or to complement different clothing or accessories. It is an object of this invention to provide shoes that that are convertible between a variety of styles and appearances to save space and expense.

While many wearers have multiple pairs of shoes, not all shoes are equally durable or comfortable. A favored pair may not complement a desired garment. It is another object of the invention to provide replaceable uppers so that a familiar, attractive, or comfortable shoe may be conveniently and reversibly altered to match or complement a new garment.

Convertible shoes permitting exchange of uppers have a long history in the art. For example, U.S. Pat. No. 3,032,896A to Weaver discloses a convertible shoe where the upper surface of the sole is provided with a vamp permanently attached to the shoe. This vamp is provided on each side with three spaced female snap fastener elements. These elements are adapted to be releasably engageable by complementary male snap fastener elements on the underside of a vamp cover. This cover may be of any desired material, color or shade and as many different covers may be provided as desired for interchangeability. This disclosure fails to allow for alteration of the style of a shoe; the base model may merely be covered with different materials.

U.S. Pat. No. 3,925,915A to Colli discloses a sandal shoe that has a removal top vamp portion detachably engaging the sidewalls of a shoe bottom. The shoe bottom consists of a forward sole portion, a middle shank, and a raised heel. A plurality of male snap members are affixed onto both sidewalls of the shoe bottom. This disclosure requires a sole portion thick enough to affix the disclosed male snap members and is thus limited to shoes with relatively thick soles.

U.S. Pat. No. 7,661,206B2 to Osborn discloses a platform shoe with detachable upper including a lower shoe member and an upper shoe member. The shoe contains snaps or other connector components that provide a detachable attachment between the upper shoe member and the lower shoe member. a plurality of snaps having male and female components, said male components having a diameter not greater than said thickness of said platform. This disclosure also requires a sole portion thick enough to affix the disclosed male snap members and is thus limited to shoes with relatively thick soles.

None of the above-noted prior art uses sturdy connections of interchangeable uppers or in conjunction with relatively thin-soled shoes. It is another object of the invention to provide such an interchangeable shoe system. Further, each of the above-noted prior art provides only a small number of possible shoe styles (considering a style based on the geometry of the uppers) because each discloses a like number of fasteners on uppers and sole. Each shoe combination of upper and sole fits the same general pattern. There is thus a need for a shoe system that permits a more flexible combination of uppers and soles to increase the range of interchangeable styles.

SUMMARY

In embodiments, the invention includes a shoe system including a sole having attached fasteners and interchangeable uppers having complementary fasteners. In other embodiments, the invention includes particular uppers that may be used in such a shoe system.

In some embodiments, the shoe system of the invention includes a sole and multiple fasteners attached to the sole. One upper includes multiple fasteners complementary to the fasteners on the sole. A second upper also includes multiple fasteners complementary to the fasteners on the sole. The complementary fasteners fasten to and unfasten from the first fasteners without use of tools. One or more of the fasteners on the sole attach to the sole through a flexible tab; the flexible tab directly contacts the sole and is permanently affixed to the sole. The first upper and the second upper may be separately fastened to the sole to produce shoes that differ in their appearance.

In embodiments, the sole may have a thickness less than that of the attached fasteners. The number of complementary fasteners on one of the uppers may be fewer than the number of fasteners attached to the sole.

The shoe system may also include a blind fastener that fastens to one of the fasteners attached to the sole to produce a more pleasing appearance. The fasteners attached to the sole and the complementary fasteners attached to each of the uppers may be snaps.

In some embodiments, the number of complementary fasteners on different uppers may differ, providing a greater versatility in shoe styles and fits. The shoe upper may also include an extra fastener for attachment of interchangeable decorations. Each decoration may include fastener complementary to the extra fastener on the upper.

Some embodiments of the upper include an adjustable strap having a strap fastener. The adjustable strap may include a heel portion and an ankle strap, with the heel portion having two free ends and a fastener (complementary to fasteners affixed to the sole) affixed proximal to each free end. The ankle strap may include two elongated flexible strips, with each strip connected to the heel portion at an angle between about 60 and about 120 degrees. When the strap fastener is engaged, the strips may form a loop that helps to fasten the shoe to the foot of a wearer.

In embodiments, the upper may include a pliable substrate having relatively narrow arms extending from a central region. Each arm may terminate in a respective end, each end may have a snap fastener.

The sole may have, at either side of its widest point, a pair of flexible tabs permanently affixed, each including at least one fastener. An upper may include a pliable substrate sized to produce a tunnel bridging the sole at about the widest point. The tunnel may be sized to accommodate the front portion of a foot when the upper is attached to the sole through the fasteners.

In other embodiments, the shoe system of the invention includes a sole having multiple attached and first and second uppers, each having multiple fasteners complementary to the fasteners on the sole. The fasteners on the uppers fasten to and unfasten from the fasteners on the sole without use of tools. There may be a fewer fasteners on one of the uppers than on the sole. The different uppers may each fasten to the sole at different times. This produces a different shoe when the first upper is fastened to the sole than when the second upper is fastened to the sole. The appearance of these alternative shoes may be different.

The number of fasteners may differ between uppers. The fasteners may include snaps. A fastener may be recessed into the side surface of a sole.

In some embodiments, an upper may include a pliable substrate having four arms extending from a central region, with each arm terminating in a curved end. Each curved end may include a snap fastener.

In other embodiments, the invention includes a shoe upper having a pliable substrate with a thickness and much less than its extent. The substrate may be bounded by curved edges, including a front and rear concave edges. Left and right forward edges may be substantially parallel to the front concave edge, and left and right back edges may be substantially parallel to the rear concave edge. The left back edge and a portion of the rear concave edge define a left rear arm; the right back edge and a portion of the rear concave edge define a right rear arm; the left forward edge and a portion of the front concave edge define a left front arm; and the right forward edge and a portion of the front concave edge define a right front arm. Each arm extends from a central region and terminates in a respective curved end. Each curved end may include a snap fastener. The radius of the front concave edge may be less than the radius of the rear concave edge. The left forward edge and the left back edge may meet at a left vertex and the right forward edge and the right back edge may meet at a right vertex.

The central region may include a snap fastener for attachment of a decoration.

In embodiments, the upper may also include a second pliable substrate that has a first portion and an adjustable strap. The first portion may have two free ends and a snap fastener affixed near to each free end. The adjustable strap may include two elongated flexible strips; each strip may be connected to the first portion at an angle between about 60 and about 120 degrees. When the strap fastener is engaged, the strips to form an adjustable loop.

DETAILED DESCRIPTION

The invention comprises a shoe system including a sole having attached fasteners and two or more interchangeable uppers having fasteners to complementary those of the sole. The fasteners allow a user to use a single sole portion of a shoe together with one of the uppers of the shoe to provide shoes in multiple styles or colors. Shoes are usually supplied in matching pairs, but the figures illustrate only one shoe of a pair. The second shoe in each pair follows the pattern of the illustrated shoe but is configured to fit the opposite foot of a user.

The directional terms used in this description include anatomical directions and positional directions. Anatomical directions are with respect to the anatomy of the foot of the wearer when the shoe is in place. Lateral is the side away from the body midline; medial is toward the body midline. Plantar is towards the bottom of the foot. Dorsal is towards the top of the foot. Forward is toward the toes; back is toward the heels. Positional directions including upward, downwards, front, back, left, and right refer to a left shoe in its normally-worn position with the bottom of the sole towards the ground and the toe end of the shoe at the front.

Figure 1A:
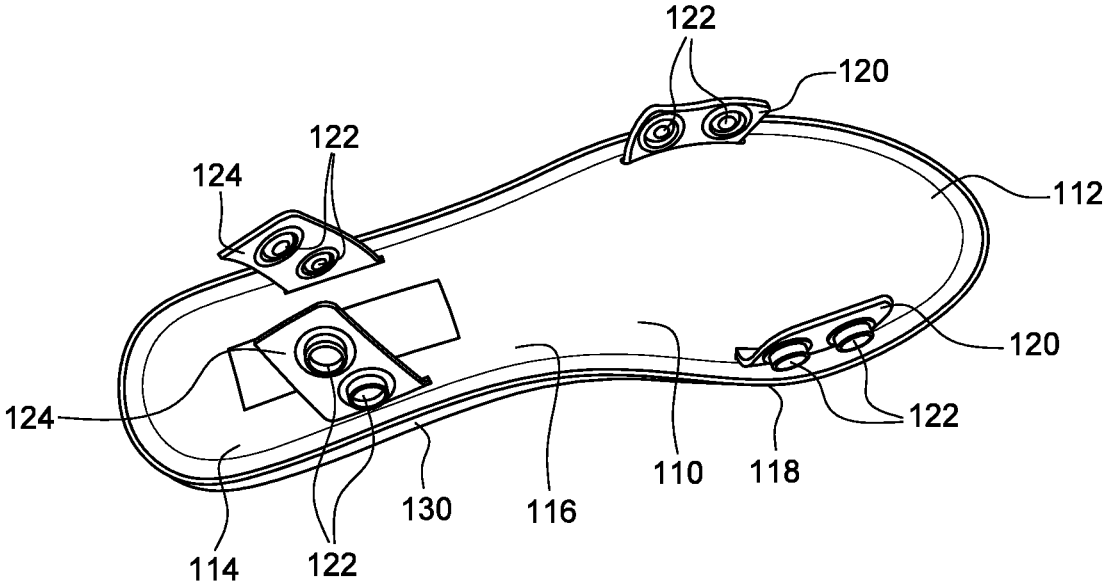
FIG. 1A shows a perspective view of a first embodiment of the lower portion of shoe system of the invention.
Figure 1B:
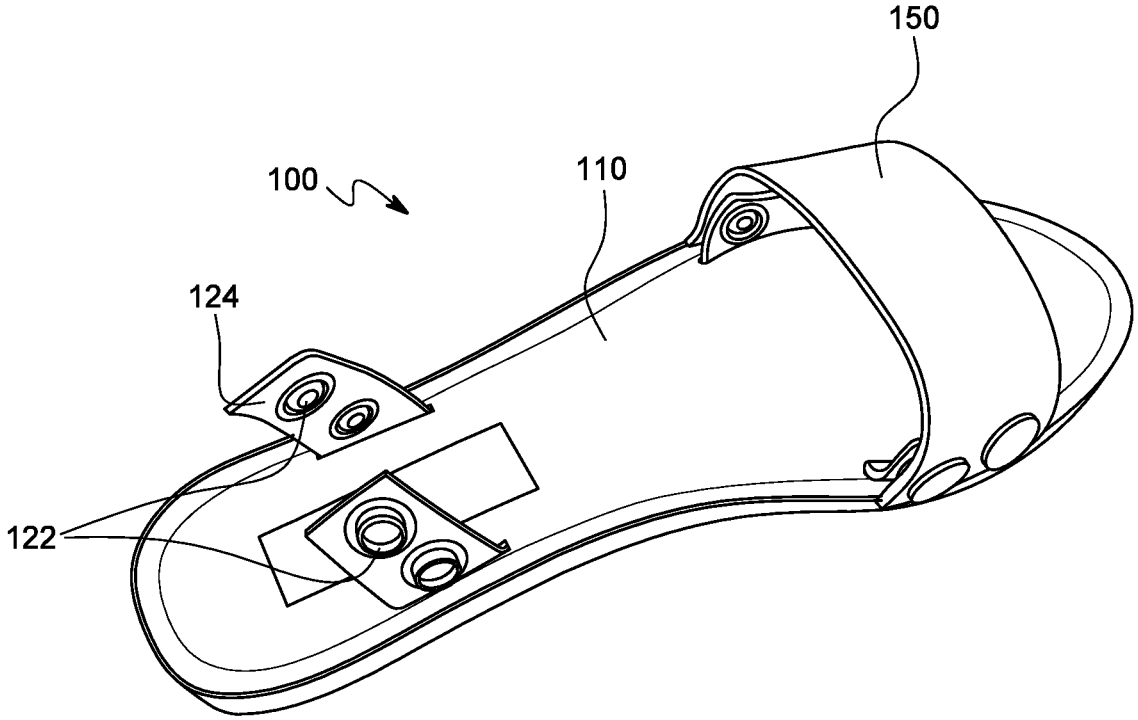
FIG. 1B shows a perspective view of the first embodiment with upper portion attached.
Figure 1C:
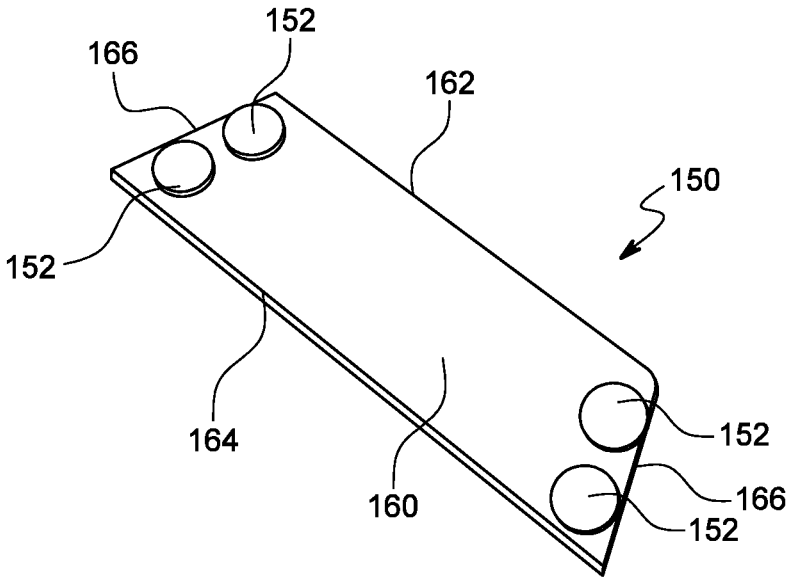
FIG. 1C shows a flattened view of the upper of the first embodiment.

Shoe 100 includes sole 110 and upper 150. FIG. 1A shows a first embodiment of one shoe 100 shown without upper 150 to more clearly show structure and relationships. FIG. 1B shows the same embodiment with upper 150 connected to sole 110 in a ready-for-wear configuration. FIG. 1C shows a flattened view of upper 150 of this embodiment.

Sole 110 is shaped generally to fit the bottom of a wearers foot. A large number of variations may be used, as are familiar from conventional shoes. As illustrated, sole 110 has a heel region 114 toward the rear of sole 110, a toe region 112 toward the front of sole 110, and an arch region 116 between the heel region and the toe region. Sole 100 is narrowest in arch region 116 and widest part 118 is within toe region 112.

The illustrated embodiment of sole 110 is of a flat sandal style. Sole 110 has a thickness 130, which in this embodiment may be about 0.3 inches. A variety of thicknesses, including non-uniform thicknesses such as in heeled or platform soles may be used with the invention, but the flat sandal illustrated better shows some of the flexibility of the invention. Sole 110 may be made of a variety of materials having suitable strength and durability, such as plastics, wood, metals, laminates, leather, other materials, or combinations. Some designs, such as the flat sandal style, are preferably flexible so that the sole remains nearly in contact with the plantar surface of the foot during walking. A flexible plastic may be used, with a textured bottom for traction and a laminated or sewn liner of leather for comfort on the plantar surface. Other sole designs, such as the heeled platform soles illustrated in FIG. 3, may be relatively rigid with a portion of the foot lifting away from the sole during normal walking.

Sole 110 includes one or more fasteners 122 to attach upper 150. While a variety of fasteners may be employed, such as zippers, hooks and eyes, clips, hook and loop textiles such as Velcro®, magnets, pins, or the like, metallic snap fasteners are preferred because of their strength, repeatability of position, ease of use, familiarity, low cost, and simple appearance.

Metallic snap fasteners are generally round and available in a variety of sizes with strength increasing with diameter. Since shoes may be subject to very large forces in use, relatively large metallic snap fasteners may be used. Metallic snap fasteners may be between about 18 Ligne to about 28 Ligne (about 11.5 to about 18 mm diameter). Metallic snap fasteners of about 24 Ligne (15 mm diameter) offer a good combination of strength, force to open or close, and size. Exemplary fasteners are Fasnap Snap fasteners available from Fasnap Corporation of Elkhart, Ind. A preferred material is stainless steel to preserve a consistent finish. These fasteners penetrate the material to be fastened and are thus visible on both sides of the material. The shoe system of the invention uses these visible portions as appearance enhancements. Colored caps are available from the same vendor or can be manufactured by overwrapping with a preferred textile to be applied as design elements.

In general, each fastener holds only one portion of an upper. In some embodiments, a fastener may serve to attach multiple layers of material, such as in the decoration of FIG. 5B.

Metallic snap fasteners have two complementary forms: male parts insert into and hold female parts. Both forms are generally mounted by introducing a hollow pin portion of a top piece through a hole in the material to be fastened and through a hole in a socket portion. The hollow pin is then deformed to lock the two parts together and entrap a flexible material between. Other metallic snap fasteners have threaded projections designed to be inserted into a hard substrate, such as a wood. These threaded types may be used in the sole of embodiments such as that of FIG. 3.

In some embodiments, fasteners 122 may be mounted to flexible tabs 120 extending from the edge or the upper surface of sole 110. Tabs 120 may be relatively thin pliable material such as leather, fabric, rubber, or plastic. Tabs 120 are permanently mounted to sole 110 to serve as anchor points for upper 150. Each tab 120 may be approximately rectangular in shape with one end embedded, adhered, laminated, or sewn into sole 110. Tabs 120 advantageously provide anchor points for uppers even when the thickness 130 of sole 110 is less than the diameter of the preferred fasteners. In the illustrated embodiment, a pair of tabs 120 are disposed on sole 110 near the medial and lateral edges of sole 110 at about widest part 118. This advantageously provides good fit between shoe and foot. Each of these tabs 120 includes two fasteners side by side to prevent rotation of upper when engaged and for a more pleasing appearance.

In other embodiments, sole 110 may include additional tabs 124. These additional tabs may be disposed at other locations about sole 110 to provide for attachment of other uppers. As illustrated, additional tabs 124 are disposed near the medial and lateral edges of sole 110 at the heel region. Each additional tab 124 includes two fasteners with one close to sole 110 and one further away. This combination allows for attachment of a heel and ankle strap as discussed in more detail below.

Still other embodiments may have unpaired tabs or have tabs with a single fastener or more than two fasteners. Each of these variations increases the number of style variations possible.

When a particular style does not use a fastener on the sole to attach a portion of the upper, the unused fastener may be covered by a "blind" fastener. The purpose of the blind fastener is to cover the unused fastener to enhance appearance of the shoe. In some embodiments, the blind fastener may include a decorative piece of textile, leather, weaving, beadwork, or other decoration.

Upper 150 may include a relatively thin pliable substrate 160 such as leather, textile, plastic, rubber, wood veneer, metal foil, or some combination. As used here, relatively thin means that pliable substrate 160 has a thickness much less than its lateral extent. For example, the thickness may range from about 0.03 inches to about 0.2 inches, while the lateral extent may be on the order of several inches. The lateral extent may vary with the shoe size. The lower (i.e. the inner) surface of pliable substrate 160 may be treated to improve comfort, such as by lining with a soft textile.

In many designs, leather may be preferred as pliable substrate 160 because it provides a combination of strength, comfort, durability, and appearance. Pliable substrate 160 may be embossed, dyed, painted, textured, coated, woven, beaded, or otherwise permanently decorated as desired for the particular style. In the illustrated embodiment, upper 150, when attached to sole 110, forms a dorsal strap defining a tunnel between sole 110 and the lower surface of pliable substrate 160. The front of a wearer's foot may be inserted into this tunnel, holding shoe 100 in place.

As visible in FIG. 1C (shown flattened to illustrate structure), upper 150 may be shaped to fit a particular shoe style and size. The dorsal strap design of upper 150 may be shaped as a trapezoid having parallel front edge 162 and rear edge 164 connecting to slanting end edges 166. Front edge 162 may be shorter than rear edge 164 to shape upper 150 to conform to a wearer's foot. The dimensions of these edges depend on the size of the shoe and on the width of the dorsal strap. For a woman's US size 7 shoe and a dorsal strap width of 37 mm, front edge 162 may be about 115 mm and rear edge 164 may be about 156 mm.

As illustrated, each end of upper 150 includes two fasteners 152. While these may be either male or female fasteners, female fasteners are preferred on upper 100 because the outer aspect of fasteners 152 is an appearance element for the design. The smooth back of the female metallic snap fasteners has a more pleasing appearance and may be modified with decorative covers for style versatility and enhancement.

The two fasteners at each end of upper 150 snap to two complementary (preferably male) fasteners on sole 110. As illustrated, each tab 120 may have more than one fastener. This both increases strength of connection between sole 110 and upper 150 and allows for versatility in shoe style. A particular upper may use both fasteners as illustrated or may use less than all of the fasteners to produce a much larger number of combinations of shoe styles.

The illustrated dorsal strap design of upper 150 is but one of many possible upper designs.

Figure 2A:
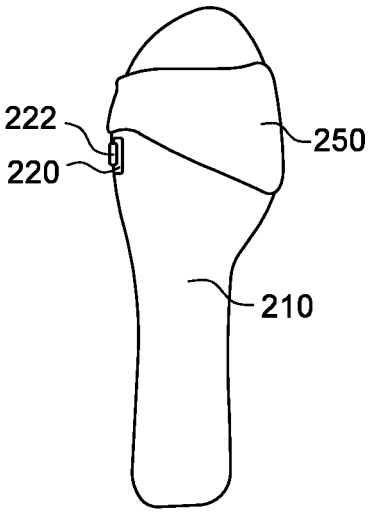
FIGS. 2A, 2B, and 2C show top views of the lower portion of the first embodiment including different uppers.
Figure 2B:
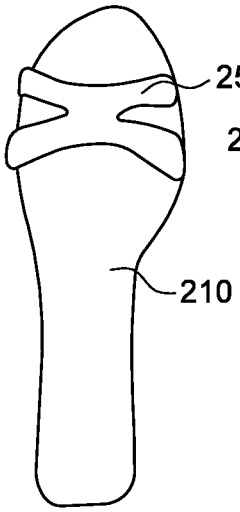
Figure 2C:
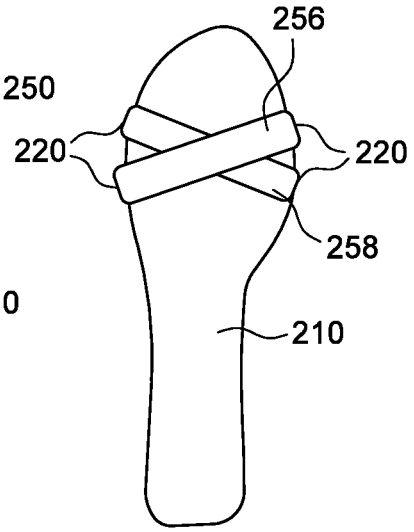

FIGS. 2A, 2B, and 2C show top views of assembled shoes including different uppers or differently placed uppers on sole 210 as style variations. Sole 210 includes a pair of tabs 220 disposed on sole 210 near the medial and lateral edges of sole 210 at about widest part. These are covered by uppers except for the unused tab 220 in FIG. 2A; item number 220 identifies the location of hidden tabs in FIG. 2C. Each tab 220 includes a fastener 222.

FIG. 2A resembles the embodiment of FIG. 1B, except that upper 250 is broad at the medial side and narrower at the lateral side providing a tapered dorsal strap. The medial side of upper 250 includes two fasteners (not visible because of the view angle) as in the embodiment of FIG. 1B. The lateral side of upper 250 includes only one fastener producing a different shoe style. Unused fastener 222 on unused tab 220 may be covered by a decorative element (not illustrated).

FIG. 2B also resembles the embodiment of FIG. 1B, except that upper 252 includes separated "arms" that each terminate in a rounded end having a fastener that engages with a complementary fastener of the tab 220.

The upper variant illustrated in FIG. 2C includes two independent straps 256 and 258, each terminating in a fastener. Straps may be connected either crossing one another as illustrated or parallel to one another with a shorter strap bridging the two forward fasteners and a longer strap bridging the two rear fasteners.

As will be readily apparent to the skilled practitioner, the shoe system of the invention makes possible designs limited only by the imagination of the designer advantageously allowing a wide variety of styles.

Figure 3:
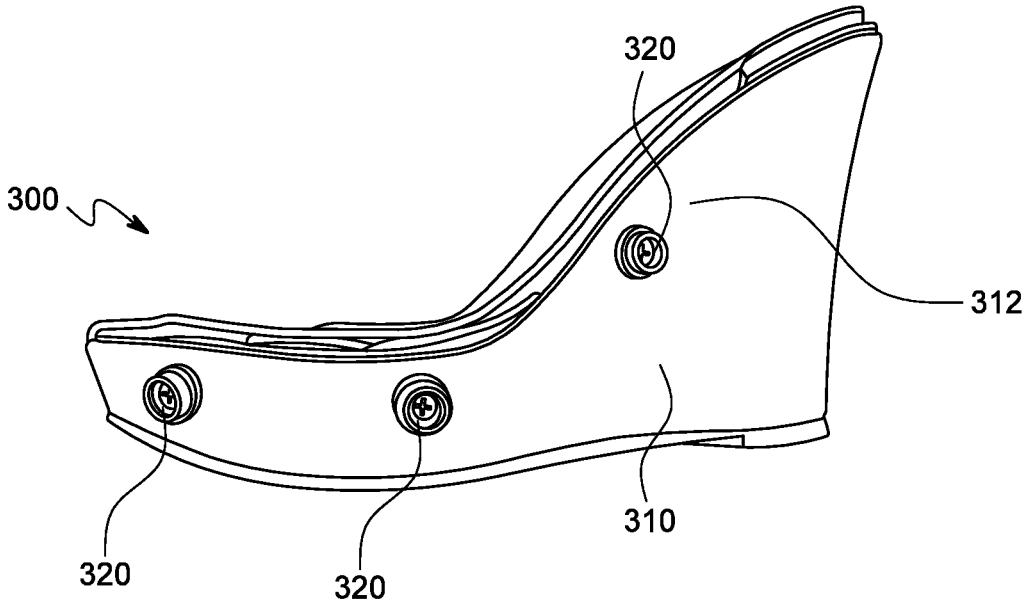
FIG. 3 shows a perspective view of a lower portion of another embodiment of the shoe system of the invention.

FIG. 3 illustrates a sole 310 of another embodiment 300. This platform shoe embodiment includes a sole having a side surface 312 with thickness greater than the width of the fasteners. In such embodiments, fasteners 320 may be attached directly to the sides of sole 310. Such fasteners are available from Fasnap Corporation as part of the Screwstuds line and include screws that hold the male fastener directly to sole 310.

In some embodiments, a fastener 320 (such as a Screwstud fastener) may be recessed in a cavity of the side surface 312 of sole 310 so that the outermost portion of fastener 320 is close to flush with the surrounding area of sole 310. The cavity may be sufficiently oversize with respect to the outside diameter of fastener 320 that the outer diameter of a complementary fastener on an upper may fit within the cavity when the fasteners are snapped together. This recessed mounting of fastener 320 advantageously improves the appearance of an upper attached to sole 310.

In some embodiments, the invention includes soles having a mix of fasteners with some directly attached to the sides and others disposed on tabs as discussed above.

Figure 4:
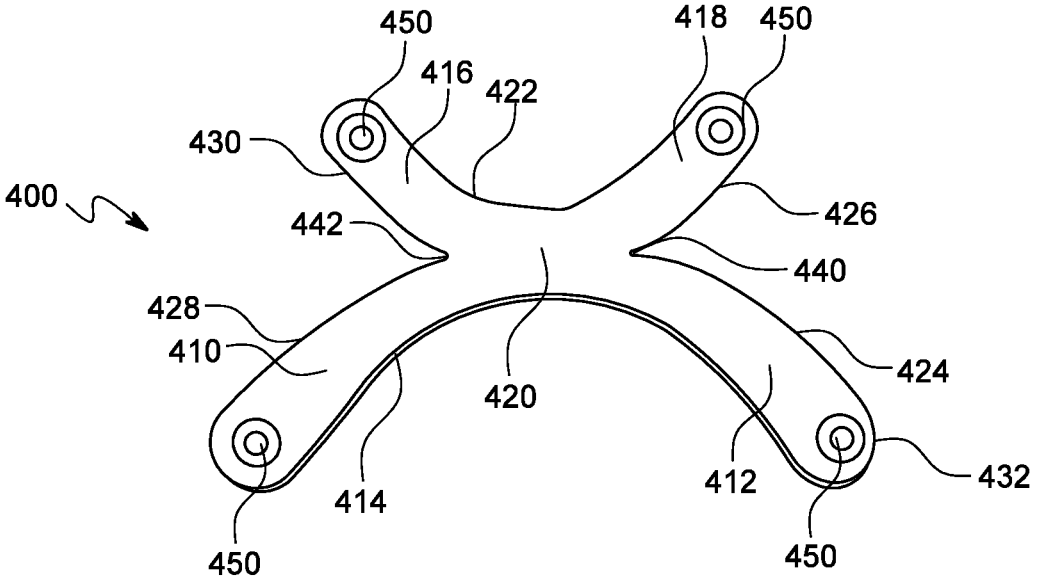
FIG. 4 shows a flattened view of an embodiment of an upper of the invention.

FIG. 4 illustrates an upper 400 similar to that illustrated in the assembled shoe of FIG. 2B. The view is of the upper 400 flattened to show the shape clearly. Upper 400 roughly resembles the letter "X" with four arms 410, 412, 416, and 418 projecting from central region 420. Upper 400 is composed of a pliable substrate such as leather with a thickness much less than its extent. The extent, as measured by the longest dimension may be about 200 mm and the thickness may be about 1 mm. The substrate may be bounded by curved edges, including a front concave edge 422 and a rear concave edge 414. Left forward edge 430 and right forward edge 426 may be substantially parallel to the front concave edge. Left back edge 428 and right back edge 424 may be substantially parallel to rear concave edge 414. Parallel here means that the edges, though curved, are approximately the same distance apart through most of their length.

Left forward edge 430 and left back edge 428 may meet at a left vertex 442; right forward edge 426 and right back edge meet at a right vertex 440. The vertices allow flexing of upper 400 between arms without unsightly buckling.

Left back edge 428 and a portion of rear concave edge 414 define left rear arm 410. Right back edge 424 and a portion of rear concave edge 414 define right rear arm 412. Left forward edge 430 and a portion of front concave edge 422 define left front arm 416. Right forward edge 426 and a portion of front concave edge 414 define right front arm 418. Each arm extends from central region 420 and terminates in a respective curved end 432. Each curved end 432 includes a male snap fastener 450.

Front concave edge 422 and rear concave edge 414, though not necessarily circular arcs, may be approximated by arcs. The radius of front concave edge 422 is less than the radius of rear concave edge 414. The radius of front concave edge 422 may be about 100 mm, and the radius of rear concave edge 414 may be about 150 mm. Upper 400 is designed to straddle a sole in the toe region of a shoe. In most soles, this toe region tapers toward the front of the shoe. When connected to complementary fasteners in the toe region of a sole, upper 400 creates a tunnel between the sole and the inner surface of upper 400. The tunnel decreases in size toward the front of the sole, making a snug fit to an inserted foot.

Figure 5A:
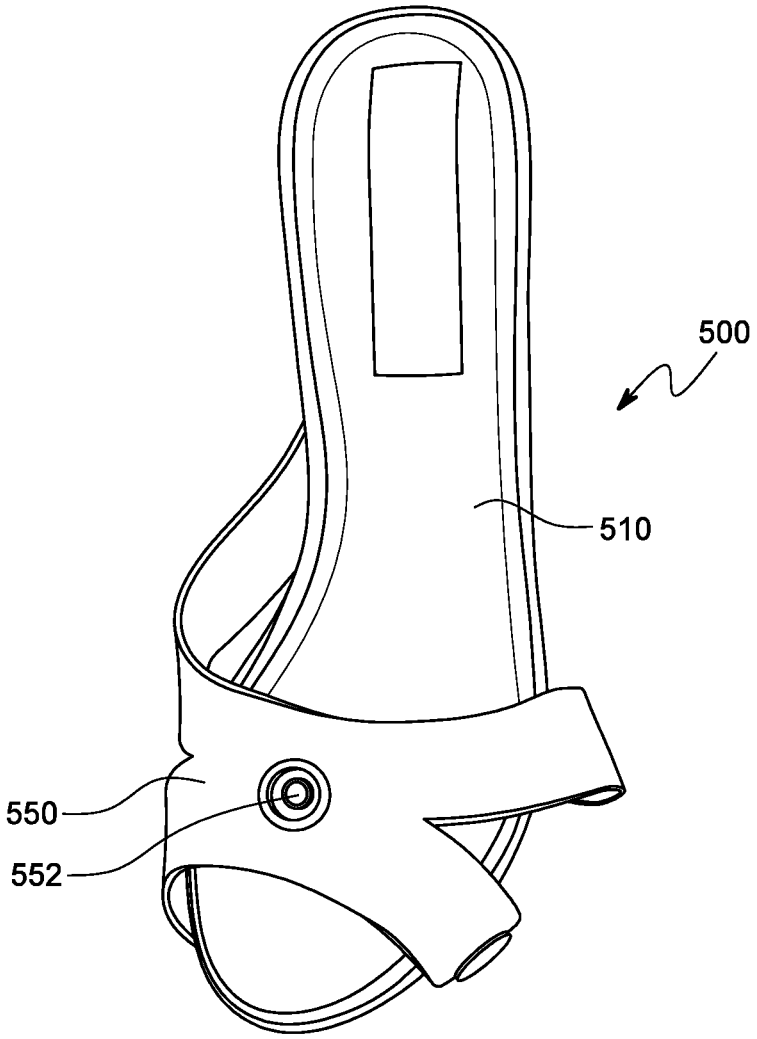
FIGS. 5A, 5B, and 5C show top views of another embodiment including the decorative elements.
Figure 5B:
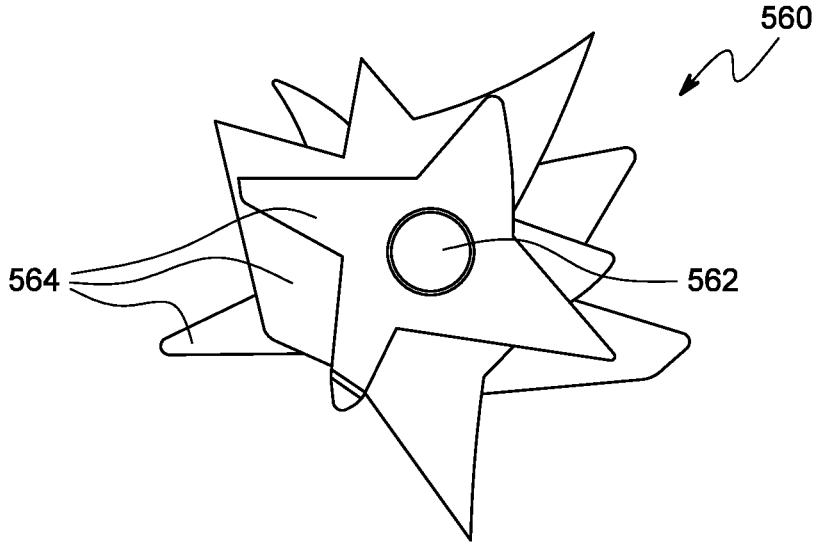
Figure 5C:
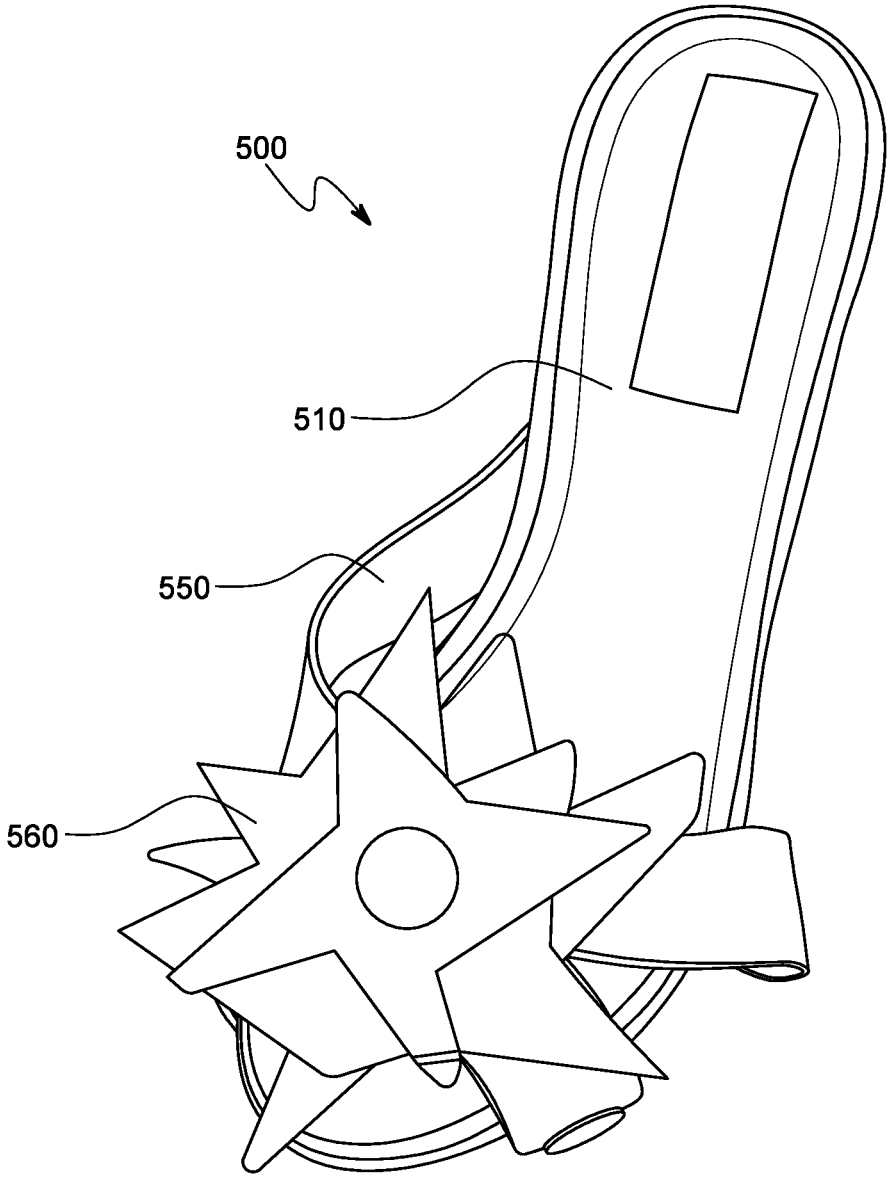

FIGS. 5A, 5B, and 5C show top views of another embodiment including attachable decorative elements. In FIG. 5A shoe 500 includes sole 510 attached to upper 550 in similar fashion to that described for the embodiment of FIG. 1. Upper 550 includes a female snap fastener 552 with the connection side upwards. Decoration 560 (FIG. 5B) is a decorative element, here illustrated by stacked polygons 564 of pliable material to create a flower-like appearance, having a male snap fastener 562. Fastener 562 is complementary to fastener 552 so that decoration 560 may be removably fastened to upper 550 as in FIG. 5C. As will be apparent, a wide range of decorations may be employed, further extending the range of styles available.

Figure 6A:
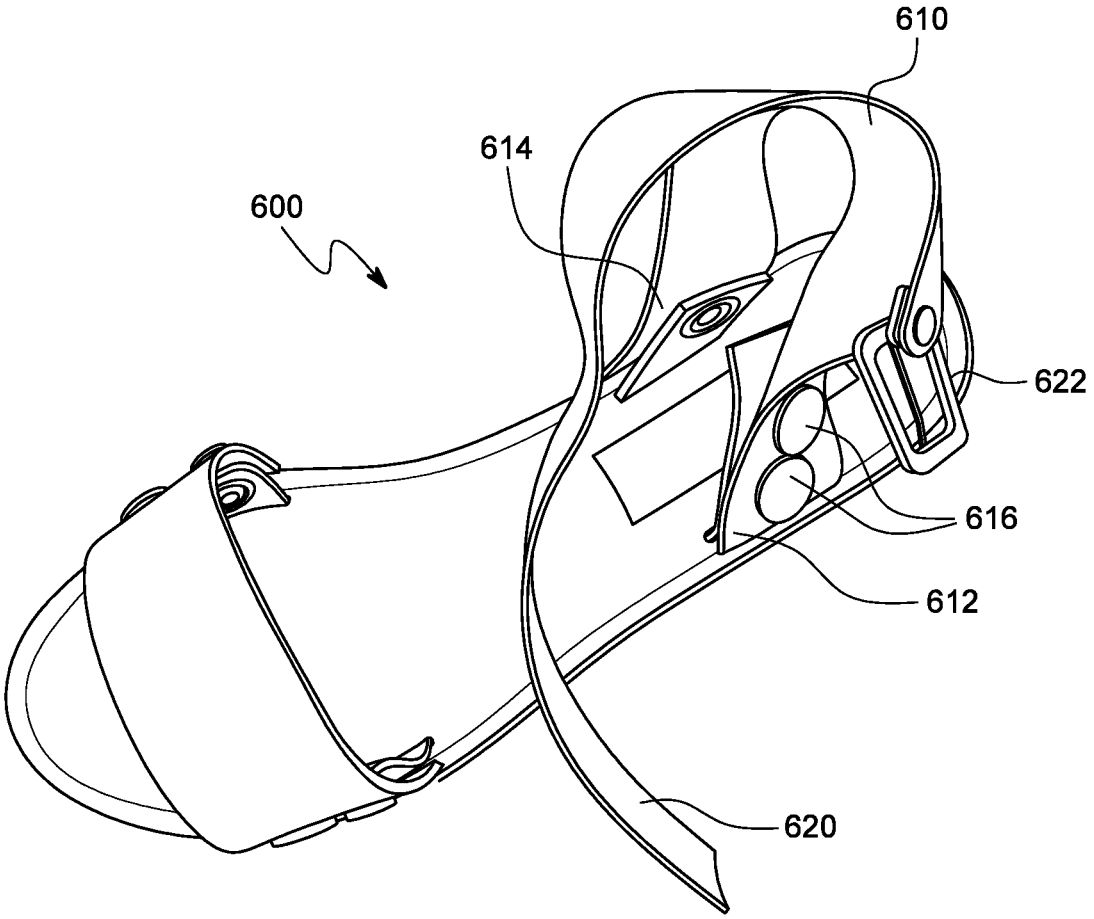
FIG. 6A shows a perspective view of an embodiment of an adjustable strap of the invention.
Figure 6B:
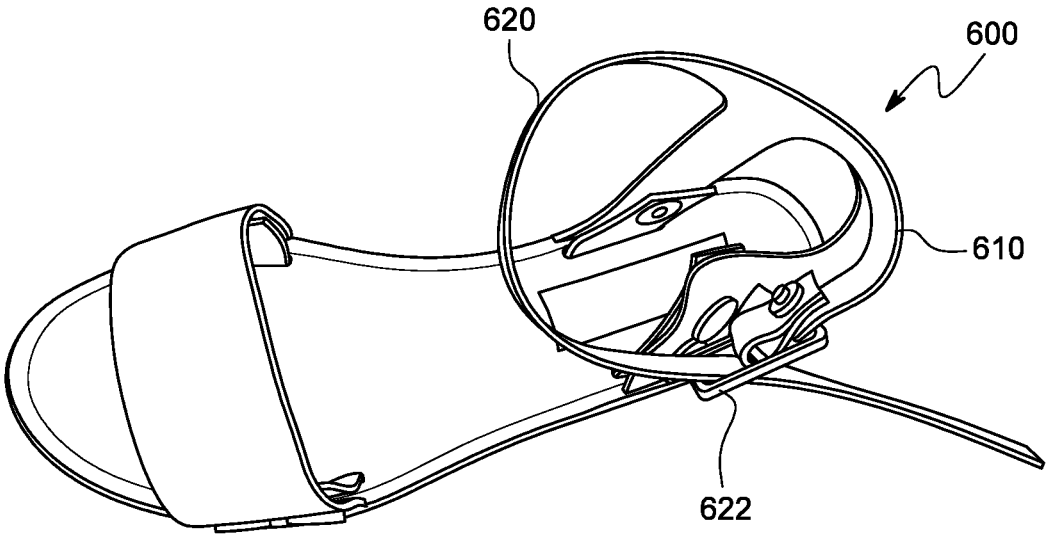
FIG. 6B shows a perspective view of the same embodiment having the adjustable strap fastened.

FIGS. 6A and 6B shows perspective views of an embodiment of shoe including an adjustable strap of the invention. FIG. 6A shows the adjustable strap open and FIG. 6B shows the same embodiment with the adjustable strap fastened.

Adjustable strap 600 is a specialized upper designed to provide an adjustable heel and ankle strap to further expand the range of styles available. Adjustable strap 600 includes a heel portion 610 and an ankle strap 620. The adjustable strap may include a pliable strip having two free ends 612 and 614. Heel portion 610 has fasteners 616 (complementary to fasteners affixed to the sole) affixed proximal to each free end 612 and 614. Ankle strap 620 includes two elongated flexible strips, with each strip connected to heel portion 610 at an angle between about 60 and about 120 degrees. A preferred angle is about 90 degrees, but this angle may be adjusted by connecting the strips to the heel portion 610 through a pivoting joint such as a rivet.

A strap fastener 622 is attached to the end of one of the strips. As illustrated, strap fastener 622 may be a belt buckle and post with holes to accommodate the post along part of the length of the second strip. When strap fastener 622 is engaged, the strips form a loop. A wearer may use the loop to fasten the shoe to the wearer's ankle.

Figure 7A:
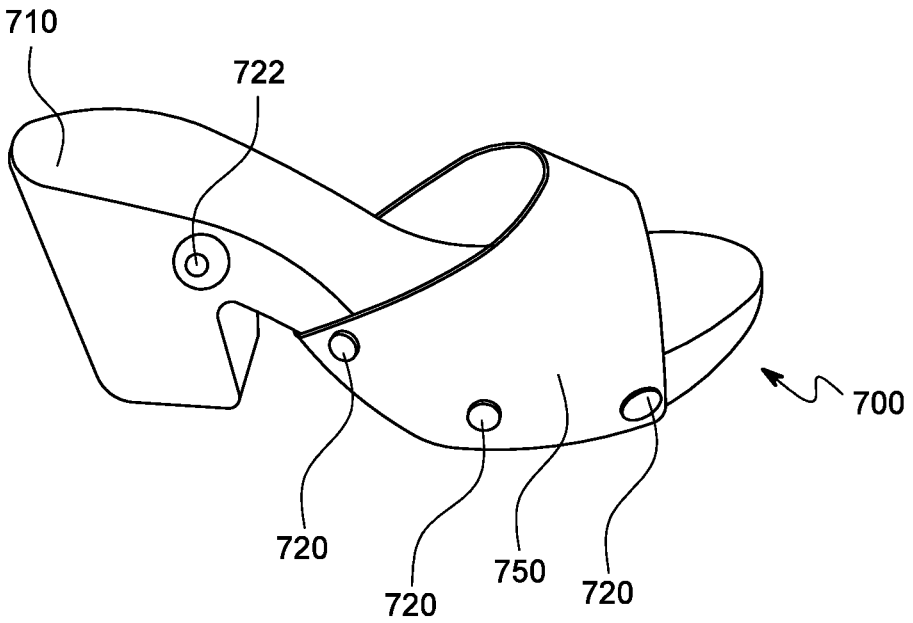
FIG. 7A shows a perspective view of another embodiment including a blind fastener.

FIG. 7A shows an assembled shoe 700 having sole 710 with fasteners on the side of sole 710 but not visible because they are covered. Upper 750 is attached to sole 710 via female snap fasteners 720. An unused fastener on sole 710 is covered by a "blind" female fastener 722. A second blind fastener is on the other side of sole 710 but not fully visible in this view. The purpose of blind fastener 722 is to improve the appearance of the assembled shoe 700. Blind fastener 722 may be a female fastener with an attractively finished cover, which may include a colored plastic cover as in the illustration. Other covers for blind fastener 722 may include textile covered, beaded, or jeweled covers.

Figure 7B:
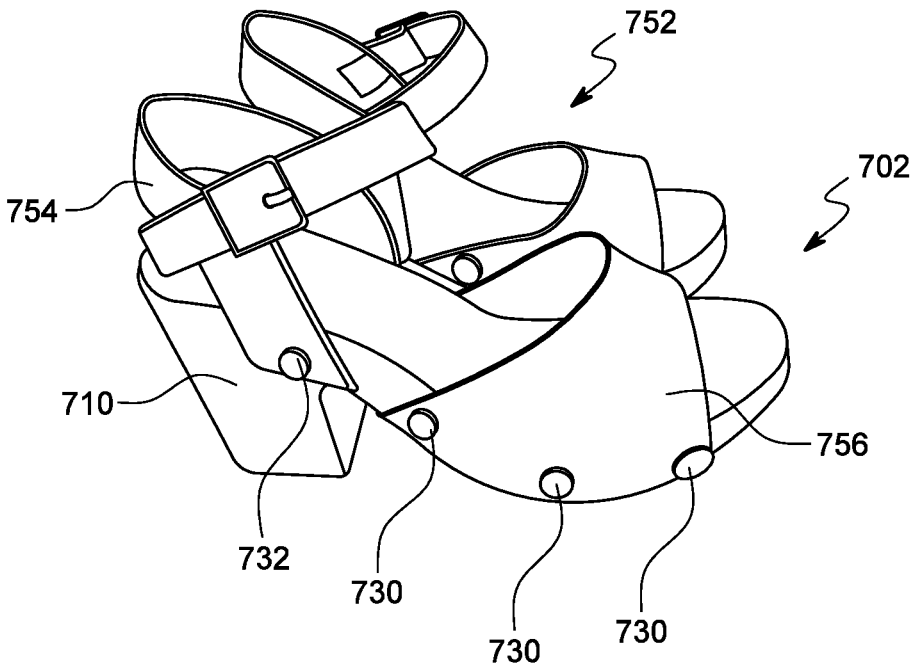
FIG. 7B shows a perspective view of an embodiment sharing the lower portion of the embodiment of FIG. 7B but with a different upper.

FIG. 7B shows two assembled shoes 702 using the same sole 710 as the embodiment of FIG. 7A. Upper 752 includes two parts: front upper 756 and rear upper 754. Front upper 756 is similar to upper 750 of the embodiment of FIG. 7A, but may be a different color. Rear upper 756 attaches to sole 710 through a fastener pair 732 that was covered by blind fasteners 722 in the FIG. 7A embodiment. in the FIG. 7A embodiment. Rear upper 756 includes a heel strap, and an ankle strap, and a strap fastener as discussed with respect to FIGS. 6A and 6B.

Upper 750 has fewer fasteners than sole 710, while upper 702 has same number of fasteners as sole 710 and thus more fasteners than upper 710. These variations further serve to illustrate the versatility of the invention.

This specification discloses various aspects of the invention with reference to particular embodiments, but it should be understood that any of the features, functions, materials, or characteristics may be combined with any other of the described features, functions, materials, or characteristics. The description of particular features, functions, materials, or characteristics in connection with a particular embodiment is exemplary only; it should be understood that it is within the knowledge of one skilled in the art to include such feature, structure, or characteristic in connection with other embodiments whether or not explicitly described. I intend the scope of the appended claims to encompass such alternative embodiments. Variations on these described embodiments will become apparent to those of ordinary skill in the art upon reading the description. The inventor expects skilled artisans to employ such variations as appropriate, and the inventor intends for the invention to be practiced otherwise than specifically described herein. Accordingly, this specification and claims include all modifications and equivalents of the subject matter recited in the claims appended hereto as permitted by applicable law.

Unless otherwise indicated, all numbers used in the specification and claims are to be understood as being modified in all instances by the term "about." Unless indicated to the contrary, the numerical values in the specification and attached claims are approximations that may vary depending upon the desired properties sought to be obtained.

The terms "a," "an," "the" and similar referents used in the context of describing the invention (especially in the context of the following claims) are intended to cover both the singular and the plural, unless otherwise indicated herein or clearly contradicted by context. All methods described herein can be performed in any suitable order unless otherwise indicated herein or otherwise clearly contradicted by context. The use of any and all examples or exemplary language (e.g., "such as") provided herein is intended merely to better illuminate the invention and does not pose a limitation on the scope of the claims. No language in the specification should be construed as indicating any non-claimed element essential to the practice of the invention.

I claim:

1. A shoe system comprising:

a sole;

a plurality of first fasteners attached to the sole;

a first upper including a first plurality of complementary fasteners;

a second upper including a second plurality of complementary fasteners; and a blind fastener not attached to an upper and configured to fasten to a fastener of the plurality of first fasteners, wherein the complementary fasteners fasten to and unfasten from the first fasteners without use of tools, wherein at least one fastener of the plurality of first fasteners attaches to the sole through a flexible tab, the flexible tab directly contacting the sole and permanently affixed to the sole, wherein the first upper and the second upper are configured to alternatively fasten to the sole, such that, the first upper fastened to the sole comprises a first shoe and the second upper fastened to the sole comprises a second shoe, wherein the plurality of first fasteners in the first shoe includes an unused fastener that does not fasten to the first upper, and wherein the blind fastener fastens to the unused fastener, and wherein the appearance of the first shoe differs from the appearance of the second shoe.

2. The shoe system of claim 1, wherein the sole has a thickness and the first fastener has a diameter greater than the thickness.

3. The shoe system of claim 1, wherein the number of complementary fasteners in the first plurality of complementary fasteners is fewer than the number of fasteners in the plurality of first fasteners.

4. The shoe system of claim 3, wherein the first fasteners and the complementary fasteners comprise snaps.

5. The shoe system of claim 1 wherein the blind fastener has a finish different from the first upper.

6. The shoe system of claim 1, wherein the number of complementary fasteners in the first plurality of complementary fasteners is fewer than the number of complementary fasteners in the second plurality of complementary fasteners.

7. The device of claim 1, further comprising a decoration including a third fastener, wherein the first upper includes a fourth fastener complementary to the third fastener.

8. The shoe system of claim 1, wherein the first upper includes an adjustable strap having a strap fastener.

9. The shoe system of claim 8, wherein the adjustable strap comprises a heel portion and an ankle strap, the heel portion having two free ends and a complementary fastener of the first plurality of complementary fasteners affixed proximal to each free end, the ankle strap comprising two elongated flexible strips, each strip connected to the heel portion at an angle between about 60 and about 120 degrees, the strips adjustable to form a loop when the strap fastener is engaged.

10. The shoe system of claim 1, wherein the first upper includes a pliable substrate having a plurality of relatively narrow arms extending from a central region, each arm terminating in a respective end, each end including a snap fastener.

11. The shoe system of claim 1, wherein the sole has a widest point, a first flexible tab and a second flexible tab permanently affixed to the sole about at the widest point, wherein the first upper includes a pliable substrate sized to produce a tunnel bridging the sole at about the widest point, the tunnel sized to accommodate the front portion of a foot.

12. A shoe system comprising:

a sole having a side surface;

a plurality of first fasteners attached to the sole;

a first upper including a first plurality of complementary fasteners;

a second upper including a second plurality of complementary fasteners; and a blind fastener consisting of a fastening element complementary to one of the plurality of first fasteners and a cover attached to the fastening element, wherein the complementary fasteners fasten to and unfasten from the first fasteners without use of tools, wherein the number of complementary fasteners in the first plurality of complementary fasteners is fewer than the number of fasteners in the plurality of first fasteners, wherein the first upper and the second upper are configured to alternatively fasten to the sole, such that, the first upper fastened to the sole comprises a first shoe and the second upper fastened to the sole comprises a second shoe, wherein the plurality of first fasteners in the first shoe includes an unused fastener that does not fasten to the first upper, and wherein the blind fastener fastens to the unused fastener, and wherein the appearance of the first shoe differs from the appearance of the second shoe.

13. The shoe system of claim 12, wherein the first plurality of complementary fasteners has fewer complementary fasteners than the second plurality of complementary fasteners.

14. The shoe system of claim 12, wherein the first fasteners and the complementary fasteners comprise snaps, and wherein a first fastener of the plurality of first fasteners is recessed into the side surface.

15. The shoe system of claim 12, wherein the first upper includes a pliable substrate having four arms extending from a central region, each arm terminating in a respective curved end, each curved end including a snap fastener.

16. The shoe system of claim 12, wherein the second upper comprises:

a pliable substrate having a with a thickness and an extent, the thickness much less than the extent, the substrate including a front concave edge;

a rear concave edge;

left and right forward edges, each substantially parallel to the front concave edge; and left and right back edges, each substantially parallel to the rear concave edge, wherein the left back edge and a portion of the rear concave edge define a left rear arm, the right back edge and a portion of the rear concave edge define a right rear arm, the left forward edge and a portion of the front concave edge define a left front arm, the right forward edge and a portion of the front concave edge define a right front arm, each arm extending from a central region and terminating in a respective curved end, each curved end including a snap fastener.

17. The shoe system of claim 16, wherein the front concave edge has a first radius and the rear concave edge has a second radius greater than the first radius.

18. The shoe system of claim 16, wherein left forward edge and the left back edge meet at a left vertex and the right forward edge and the right back edge meet at a right vertex.

19. The shoe system of claim 16, wherein the central region includes a snap fastener for attachment of a decoration.

20. The shoe system of claim 16, further comprising a second pliable substrate, a first portion, and an adjustable strap, the first portion having two free ends and a snap fastener affixed proximal to each free end, the adjustable strap comprising two elongated flexible strips, each strip connected to the first portion at an angle between about 60 and about 120 degrees, the strips adjustable to form a loop when the strap fastener is engaged.

* * * * *